US010472168B2

(12) United States Patent
Sullinger et al.

(10) Patent No.: US 10,472,168 B2
(45) Date of Patent: Nov. 12, 2019

(54) FLEXIBLE CONTAINER LINER WRINGING DEVICE

(71) Applicant: ILC Dover IP, Inc., Frederica, DE (US)

(72) Inventors: Randy R. Sullinger, Columbia, MO (US); Tony R. McKee, Millsboro, DE (US)

(73) Assignee: ILC Dover IP, Inc., Frederica, DE (US)

( * ) Notice: Subject to any disclaimer, the term of this patent is extended or adjusted under 35 U.S.C. 154(b) by 955 days.

(21) Appl. No.: 14/874,776

(22) Filed: Oct. 5, 2015

(65) Prior Publication Data

US 2017/0096293 A1 Apr. 6, 2017

(51) Int. Cl.
*B65B 69/00* (2006.01)
*B65D 88/54* (2006.01)
(Continued)

(52) U.S. Cl.
CPC ..... *B65D 88/546* (2013.01); *B30B 9/20* (2013.01); *B65D 88/54* (2013.01); *B65D 90/046* (2013.01); *B65D 2590/046* (2013.01)

(58) Field of Classification Search
CPC ..... A47L 13/58; A47L 13/59; A47L 13/60; B30B 3/04; B30B 3/045; B30B 3/05; B30B 3/005; B30B 9/20; B30B 9/202; B30B 9/3039; B28B 3/126; B65D 35/28; B65D 35/285; B65D 33/01; B65D 37/00;
(Continued)

(56) References Cited

U.S. PATENT DOCUMENTS 323,062 A * 7/1885 Murphy ..... B30B 9/202 100/158 R
1,534,768 A * 4/1925 Brown ..... B28B 3/126 100/158 R
(Continued)

FOREIGN PATENT DOCUMENTS

JP 2011230850 11/2011

OTHER PUBLICATIONS

International Search Report for PCT/US2016/055424 dated Jan. 24, 2017.
(Continued)

*Primary Examiner* — Shelley M Self
*Assistant Examiner* — Katie L. Parr
(74) *Attorney, Agent, or Firm* — Baker, Donelson, Bearman, Caldwell & Berkowitz, PC; Dorian Kennedy

(57) ABSTRACT

A liner wringing device (10) is disclosed for use with a container liner. The wringing device includes a housing (30) with an internal cavity which houses the mechanical components of the wringing device. The housing defines a central liner compression channel (40). The internal components include a bottom support plate (42) with a central opening 43 aligned along the central channel. The wringing device also includes a drive assembly (44) formed by four elastomeric rollers (45) positioned so that the peripheral contact surfaces (50) are aligned generally tangentially with the central channel. The four rollers are each mounted to a drive shaft/axle which includes bevel gears which are meshed so that all four rollers rotate in simultaneous, synchronic rotation through the actuation of a pneumatic air gear motor (57).

14 Claims, 6 Drawing Sheets

(51) Int. Cl.
*B30B 9/20* (2006.01)
*B65D 90/04* (2006.01)

(58) Field of Classification Search
CPC ..... B65D 88/54; B65D 88/546; B65D 2590/046; B65D 90/046; B65H 75/4407; B65H 75/4486; B65H 23/0253; B65H 2701/33; B65H 2701/332; B65H 2701/333; B65H 75/4402; B65H 75/36; F26B 5/14; B67D 7/0216; B67D 7/0255
USPC ..... 100/116, 173, 242, 104, 218, 155 R, 100/158 R, 164, 169, 176, 121, 161, 165, 100/37, 41, 106, 126, 127, 110, 168, 172; 222/100, 101, 102; 15/260, 262; 242/419.5
See application file for complete search history.

(56) References Cited

U.S. PATENT DOCUMENTS 2,422,353 A * 6/1947 Hitt ..... B65H 75/4402 242/157 R
3,275,197 A 9/1966 Eklund
4,476,998 A 10/1984 Bonerb et al.
4,673,112 A 6/1987 Bonerb
4,796,788 A 1/1989 Bond
4,889,049 A 12/1989 Foster et al.
5,096,092 A 3/1992 Devine
5,335,820 A 8/1994 Christianson
5,447,100 A * 9/1995 Chesterfield ..... A61B 17/06166 100/161
5,511,696 A * 4/1996 Gustafson ..... B65D 35/285 222/102
5,636,764 A 6/1997 Bonerb
5,765,723 A 6/1998 Wilcox
5,836,363 A 11/1998 LaFleur
6,120,181 A 9/2000 Wilcox
6,216,520 B1 * 4/2001 Ochi ..... B21B 13/103 72/224
6,234,351 B1 5/2001 Wilcox
6,427,873 B2 8/2002 Wilcox
6,467,652 B2 10/2002 Wilcox et al.
6,875,310 B2 * 4/2005 Beck ..... D21F 3/0263 100/155 R
7,254,863 B1 8/2007 Morad
8,944,801 B2 * 2/2015 Heymanns ..... B30B 11/228 100/155 R
2008/0257447 A1 10/2008 Mauger et al.

OTHER PUBLICATIONS

Written Opinion of the ISA for PCT/US2016/055424 dated Jan. 24, 2017.

* cited by examiner

FLEXIBLE CONTAINER LINER WRINGING DEVICE

TECHNICAL FIELD

This invention relates to devices used to extract the material contents from liners used in conjunction with containers, and particularly to devices used to help extract the material contents from intermediate bulk container liners through the wringing of the liner.

BACKGROUND OF THE INVENTION

Flexible liners are oftentimes utilized in conjunction with intermediate bulk containers which are typically 42 to 48 inches is length, width and height, to ship large quantities of liquid, viscous or granular products. A problem long associated with the use of such liners has been the complete or near-complete evacuation of the contents from within the liner. As such, some liners have utilized pressurized regions to lift or angle the bottom of the liner or to move the interior sidewalls inwardly so as to move the contents closer to the outlet of the liner. While these devices have aided in the evacuation of the liner they can still result in rather large quantities of content remaining within the liner. This type of container also requires the use of additional pressurizing equipment to pressurize the inflatable regions.

Liners have also been designed with only a top fitment so that a vacuum hose head may be positioned within the top fitment to vacuum out the contents of the liner. A problem associated with this type of liner has been that as the contents are evacuated the liner material oftentimes folds and contacts another portion of the liner, thereby blocking the evacuation path. As such, an unacceptable amount of content material may again remain within the liner.

Accordingly, it is seen that a need remains for a device to aid with a more efficient evacuation of the liner's contents, especially those used with intermediate bulk containers. It is to the provision of such therefore that the present invention is primarily directed.

SUMMARY OF THE INVENTION

A liner wringing device for use with a flexible liner containing material therein comprises a mounting plate having an opening therein, a first roller mounted to the mounting plate directly adjacent the opening of the mounting plate, a second roller mounted to the mounting plate directly adjacent the opening of the mounting plate, a third roller mounted to the mounting plate directly adjacent the opening of the mounting plate, and a drive mechanism coupled to the first roller, the second roller, and the third roller, whereby the actuation of the drive mechanism causes the first, second and third roller to rotate thereby pulling the liner between the rollers through the mounting plate opening.

DETAILED DESCRIPTION

Figure 1:
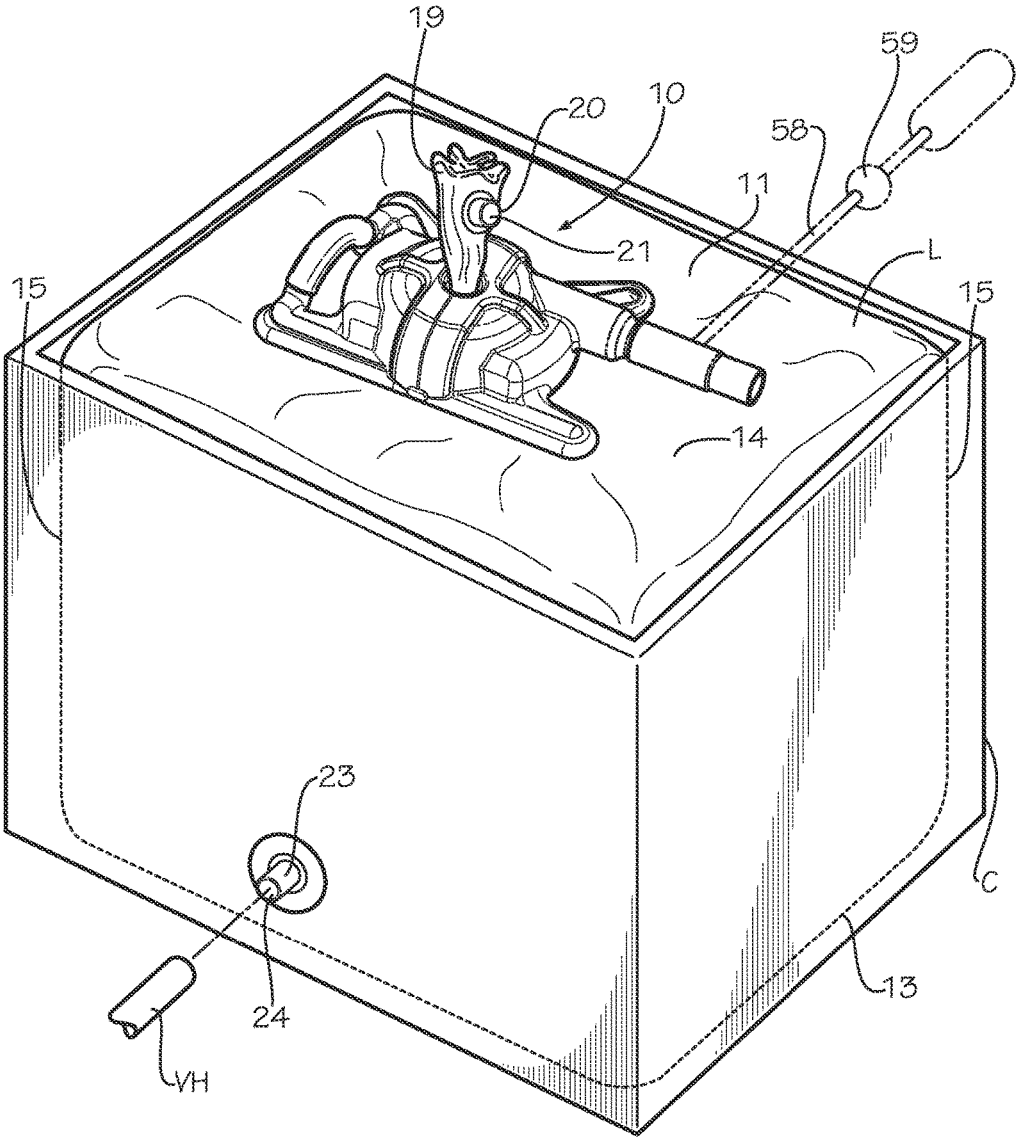
FIG. 1 is a perspective view of a liner wringing device embodying principles of the invention in a preferred form, shown coupled to a liner and liner container.
Figure 2:
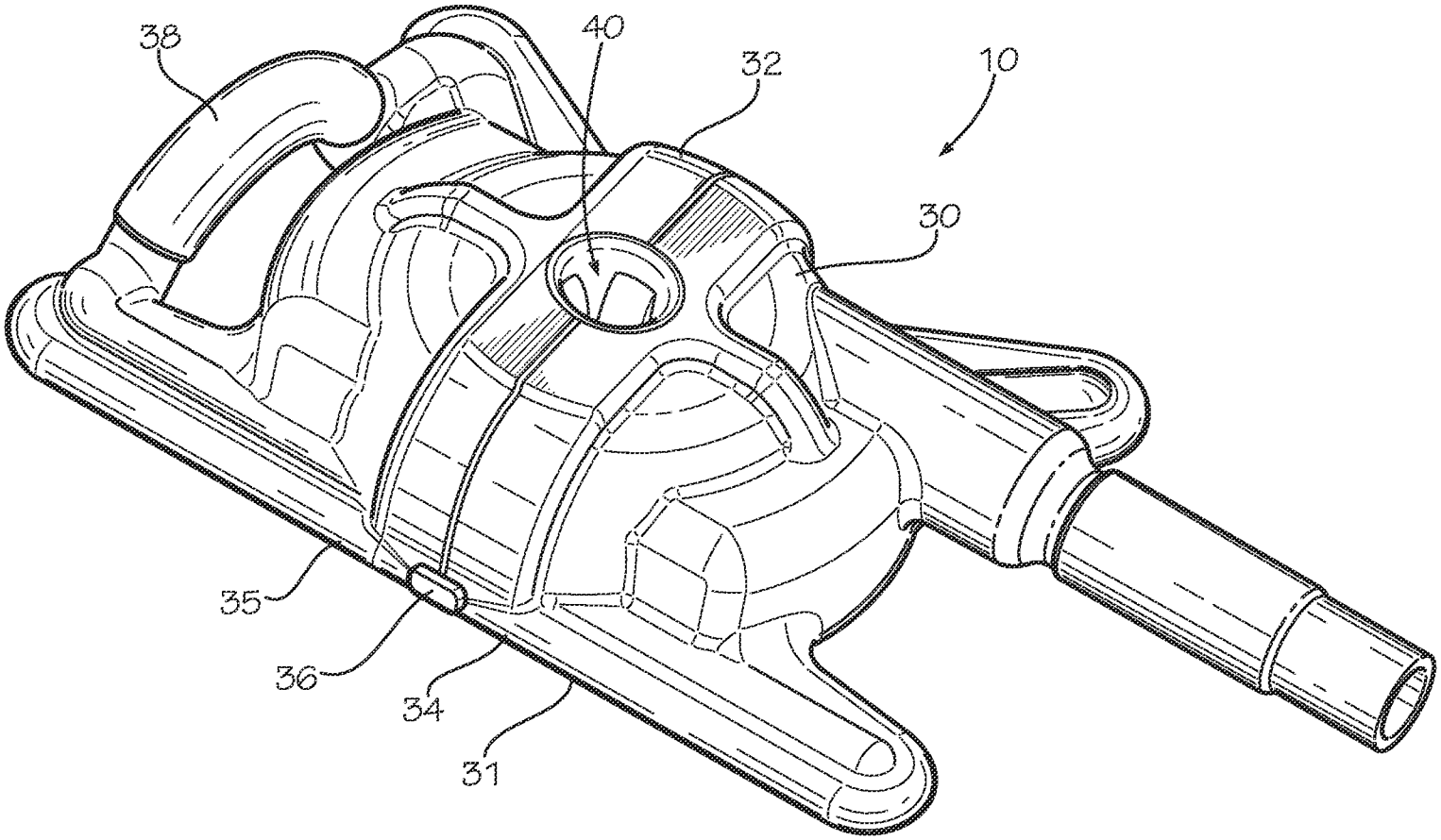
FIG. 2 is a perspective view of the liner wringing device of FIG. 1.
Figure 3:
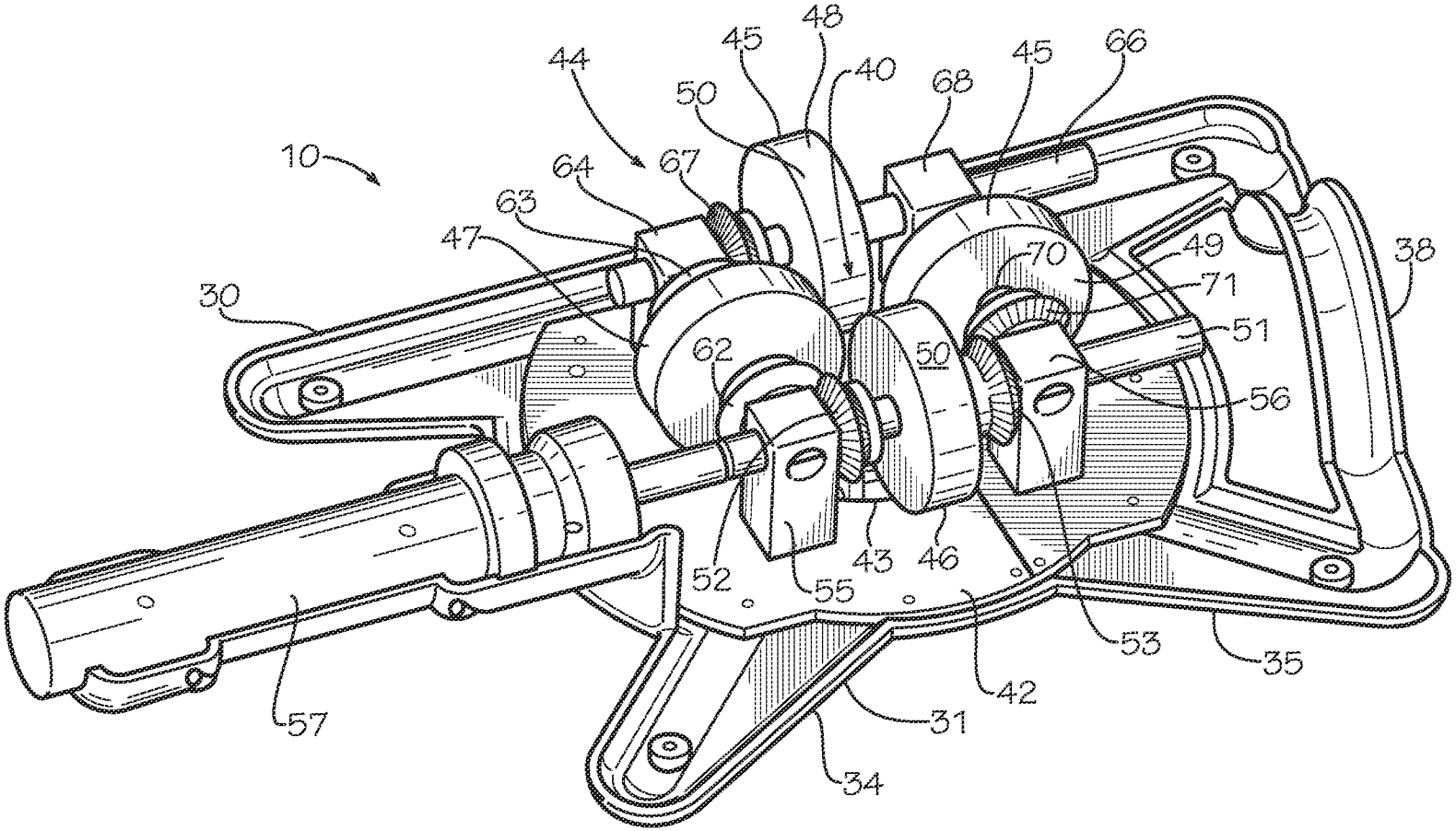
FIG. 3 is a perspective view of the liner wringing device of FIG. 1, shown with a top portion of the housing removed.
Figure 4:
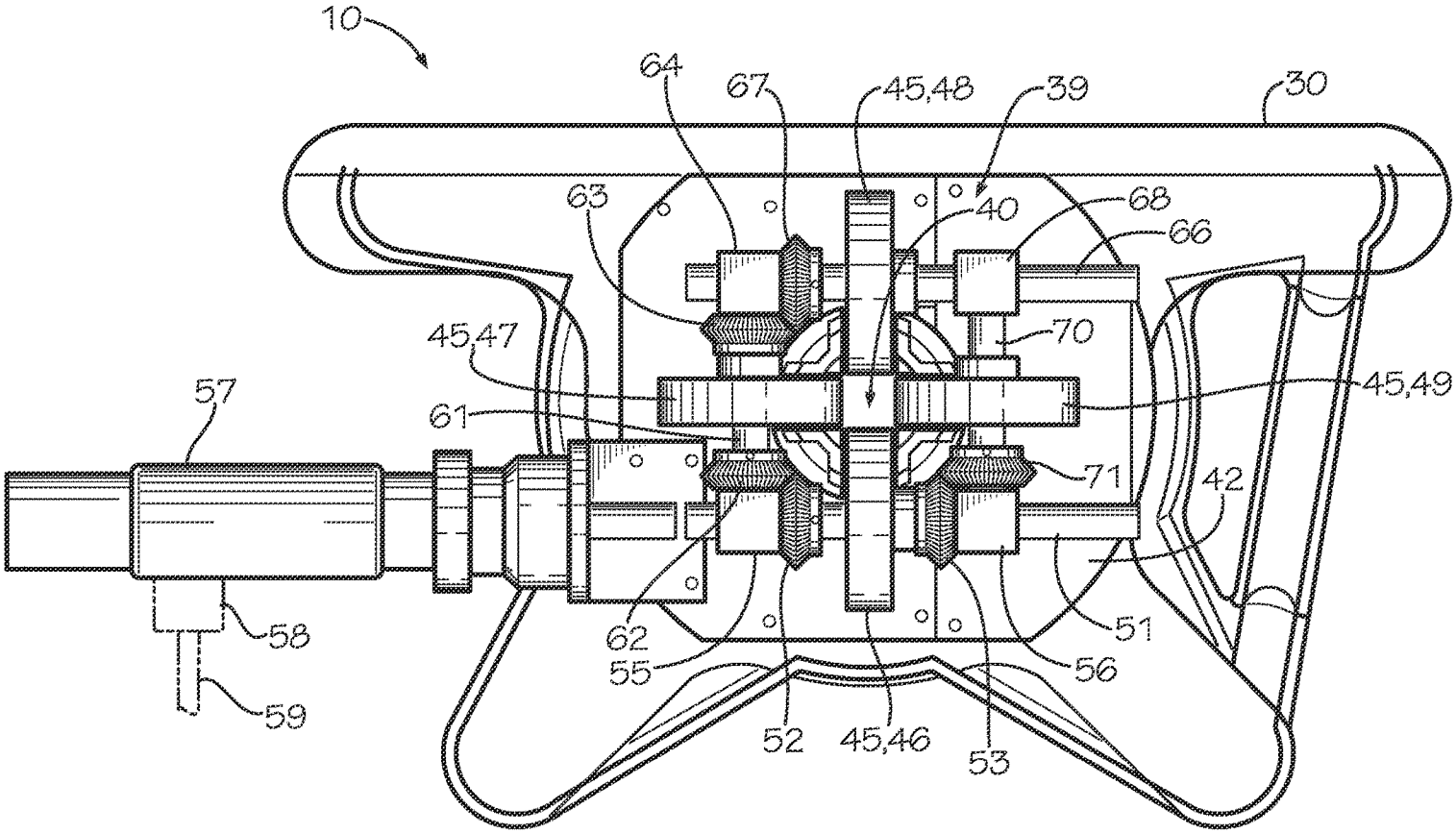
FIG. 4 is a top view of the liner wringing device of FIG. 1, shown with a top portion of the housing removed.

With reference next to the drawings, there is shown a flexible container liner wringing device 10 embodying principles of the invention in a preferred form. The wringing device 10 is configured to be used in conjunction with a flexible container or liner L positioned within a container C, which is preferably in the form of a rigid intermediate bulk container but which may also be in the form of a flexible bag or a semi-rigid container.

The liner L has a liner body 11 with a bottom wall 13, a top wall 14 and four peripheral side walls 15 extending between the bottom wall and top wall so as to define a generally box shape configuration. The top wall 14 also includes a tubular excess liner material or chute 19 which includes a filling fitment 20 with a fitment cap 21. The liner L also has a cylindrical, hose content inlet/outlet port or bottom fitment 23, having a fitment cap 24, which extends through the liner bottom wall 13 or side wall 15 adjacent the bottom wall. A vacuum hose VH may be coupled to the bottom fitment in fluid communication with the interior space of the liner to aid in the extraction of the material within the liner.

The liner's box shape can be described generally as a rectangular prism, although it should be understood that due to the nature of flexible materials the walls follow the shape of the container. Furthermore, flexibility of the plastic material enables the walls to collapse during dispensing without interference. The liner body may be made of a plastic sheet or film material such as a polyethylene film.

The wringing device 10 includes an exterior shell or housing 30 having a bottom half 31 and a top half 32 which define an internal cavity or compartment 39 which houses the internal mechanical components of the wringing device 10. The housing is also divided between a motor portion 34 and a handle portion 35 which are removably coupled to each other though a pair of latches 36 which enable the motor portion 34 to be moved away from or separated from the handle portion. The housing motor portion 34 forms a handle 38. The housing 30 also defines a central liner compression hole, pathway or channel 40 partially defined by both the motor portion and the handle portion through which the liner passes during initial use of the wringing device 10. The housing 30 has a metal bottom support plate 42, which may be considered part of the housing and central liner compression channel 40, coupled to the housing bottom half 31 for mounting the mechanical components described hereinafter. The bottom support plate is also divided into a motor portion associated with the motor portion of the housing and a handle portion associated with the handle portion of the housing. The bottom support plate 42 includes a substantially enclosed central opening 43 aligned along the central liner compression channel 40.

The wringing device 10 internal mechanical components are utilized to draw the liner L through the wringing device 10 thereby forcing the material or contents within the liner towards the bottom of the liner, or more precisely, to move the wringing device downwardly along the emptied or wrung portion of the liner as the material is extracted, thereby maintaining the material within the bottom portion of the liner. The mechanical components include a drive assembly 44 formed by four elastomeric rollers 45, such as neoprene rollers, positioned so that the outer or peripheral contact surfaces 50 of the rollers are aligned generally vertically to and tangentially with, adjacent to, or along the central channel 40, i.e., the four rollers are each positioned so that the outer contact surface 50 of the roller is vertically positioned along the central channel 40 so that they each contact and engage a portion of the liner as it passes through the central pathway. The four rollers 45 are oriented in a cross or + shaped configuration so that both pairs of oppositely disposed rollers squeeze the liner there between, which prevents the material from being squeezed sideways within the liner thereby avoiding being squeezed downwardly. In other words, the first roller is generally axially parallel to the oppositely disposed third roller, while the second roller is generally axially parallel to the oppositely disposed fourth roller, with the first and third rollers being generally axially perpendicular to the second and fourth rollers. Opposite pairs of rollers may be considered to be pairs of generally axially parallel aligned rollers. The term axially parallel and axially perpendicular is intended to mean an alignment with reference to an imaginary line extending along the axis of the roller or generally along the drive shaft/axle supporting the roller.

The four rollers 45 consist of a first roller 46, a second roller 47, a third roller 48 and a fourth roller 49. The first roller 46 is mounted to a first drive shaft/axle 51 which also includes a first bevel gear 52 and a second bevel gear 53. The first drive shaft/axle 51 is mounted to the bottom support plate 42 through a first roller support block 55 and a second roller support block 56, through which the first drive shaft/axle 51 is journalled. The end of the first drive shaft/axle 51 is coupled to a pneumatic air gear motor 57 which rotatably drives the first drive shaft/axle 51. The pneumatic air gear motor 57 is coupled to a source of pressurized air through a pressure line 58 and pressure regulator 59. The pneumatic air gear motor 57 may be a Ingersoll-Rand model number #41007RVR188BR6 with a starting torque of 76.5 lg/ft, a stall torque of 102 lb/ft, a speed max power of 47 rpm, and a max air consumption of 33 scfm.

The second roller 47 is mounted to a second drive shaft/axle 61 which also includes a third bevel gear 62 and a fourth bevel gear 63 and is rotatably coupled to a third roller shaft support block 64. The third bevel gear 62 is configured to mesh with the first bevel gear 52 of the first drive shaft/axle 51 so that rotation of the first bevel gear 52 drives the rotation of the third bevel gear 62, which in turn rotates the fourth bevel gear 63, the second drive shaft 61, and the associated second roller 47.

The third roller 48 is mounted to a third drive shaft/axle 66 which also includes a fifth bevel gear 67 and is rotatably coupled to a fourth roller shaft support block 68 and the first roller shaft support block 55. The fifth bevel gear 67 is configured to mesh with the fourth bevel gear 63 so that rotation of the fourth bevel gear 63 drives the rotation of the fifth bevel gear 67, which in turn drives the rotation of the third drive shaft 66 and the associated third roller 48.

The fourth roller 49 is mounted to a fourth drive shaft/axle 70 which also includes a sixth bevel gear 71 and is rotatably coupled to the second and fourth roller shaft support blocks 56 and 68. The sixth bevel gear 71 is configured to mesh with the second bevel gear 53 so that rotation of the second bevel gear 53 drives the rotation of the sixth bevel gear 71, which in turn drives the rotation of the fourth drive shaft/axle 70 and the associated fourth roller 49.

Thus, the first, second, third and fourth drive shafts are linked together for simultaneous rotational movement through their respective bevel gears with rotation of the first drive shaft which is forcibly driven through the actuation of the pneumatic air gear motor 57. This simultaneous rotation of the four drive shafts transfers or translates to similar simultaneous rotational movement of the four rollers 45 coupled to the drive shafts. The placement and configuration of the bevel gears enables each of the four rollers 45 to rotate at the same speed in an upward direction (synchronic motion) at a location tangential to the central channel 40.

Figure 5:
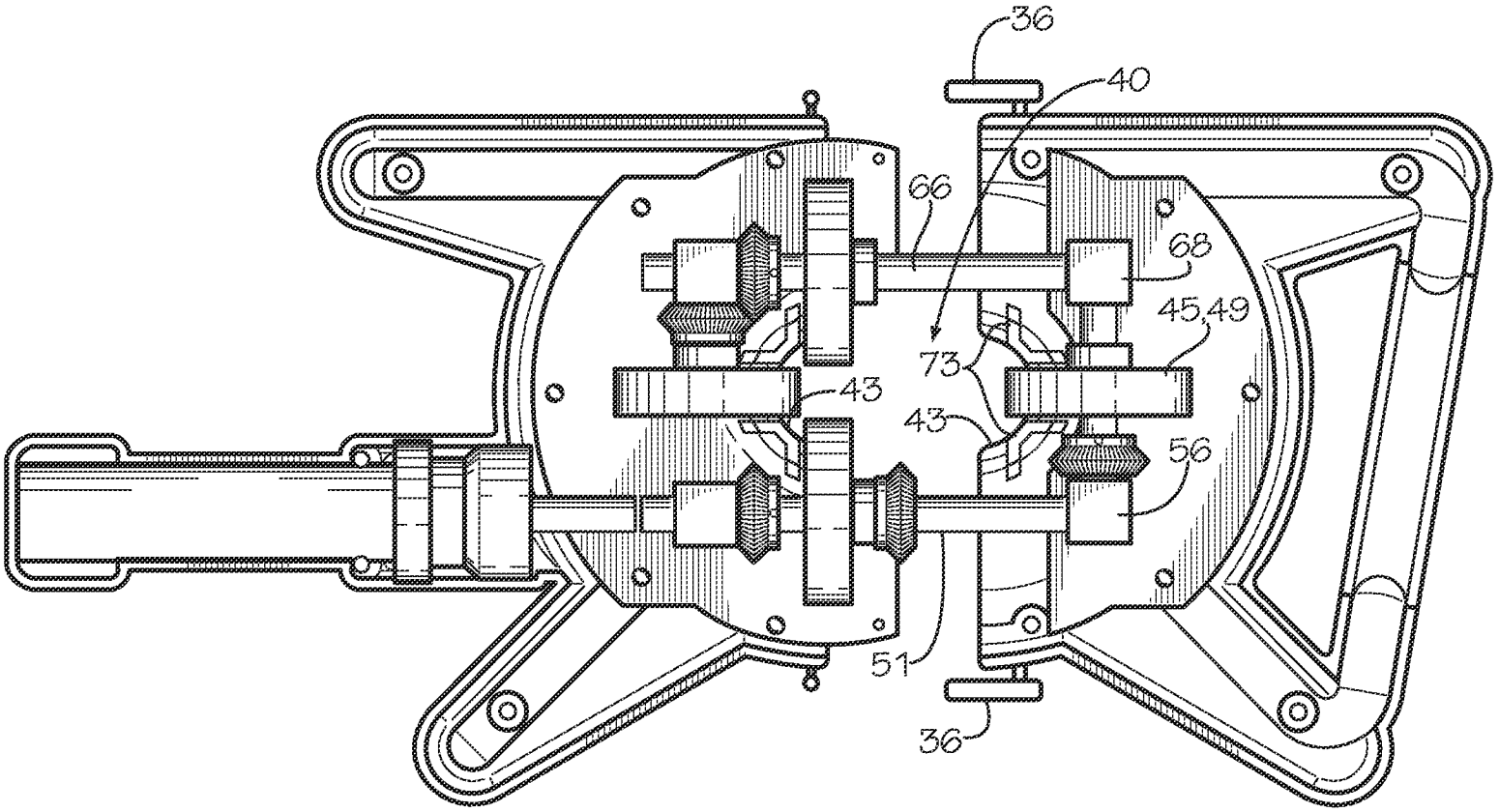
FIG. 5 is a top view of the liner wringing device of FIG. 1, shown in a separated configuration.

It should be understood that one of more of the drive shafts may be coupled to an in-line latching mechanism, such as latches 36, which when opened disengages and moves one of the drive shafts or rollers outwardly to facilitate the passage of the top filling fitment 20 and chute 19 through the central channel 40 during initial placement of the liner through the wringing device 10. As shown in FIG. 5, the in-line latching mechanism is preferably associated with and for movement of the fourth drive shaft/axle 70 as the second and fourth support blocks, 56 and 68 respectively, associated with the fourth drive shaft/axle 70 are mounted to the bottom support plate of the handle portion 35 so that these support blocks may slide along the extended length of the first and third drive shaft/axles shown in the drawings. As a safety measure, the in-line latching mechanism may prevent the airline to the air gear motor 57 from being attached when in an unlatched position.

The wringing device 10 also includes four curved guide or glide blocks 73, each of which is positioned between and adjacent to each pair of adjacent rollers. The ends of the glide blocks 73 are positioned close to the roller to aid in ensuring proper alignment of the roller and to prevent the gathering of the liner between adjacent rollers during use.

Figure 6:
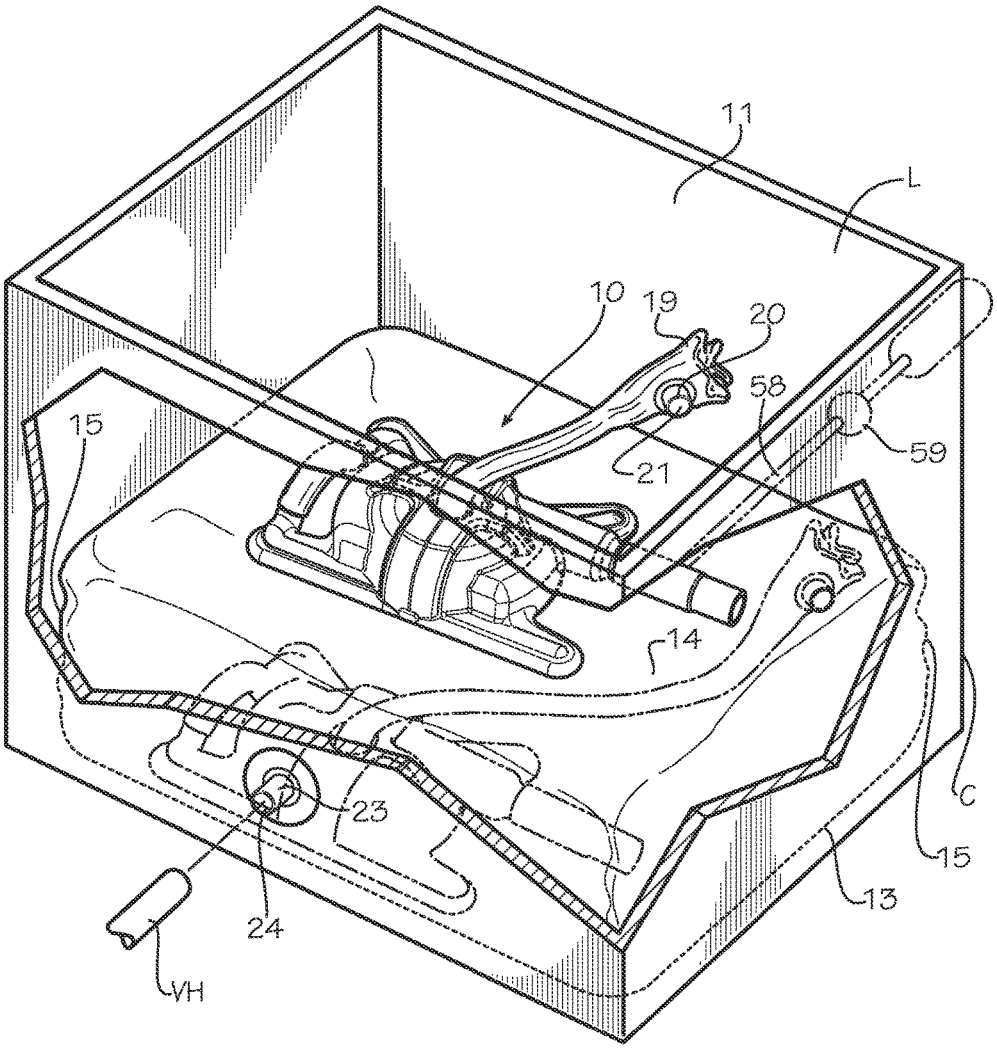
FIG. 6 is a perspective view of the liner wringing device of FIG. 1 shown partially emptied and fully emptied in phantom lines.

In use, the chute 19 and top filling fitment 20 are passed through the central channel 40 of the wringing device 10 until the wringing device 10 rests upon the top wall 14 of the liner, as shown in FIG. 1. The housing latches 36 may be unlatched to allow limited separation between the motor portion 34 and the handle portion 35 to allow the fourth drive shaft/axle to be moved to increase the size of the central liner compression channel 40 and opening during initial mounting of the liner, as shown in FIG. 5, i.e., the fourth roller and fourth drive shaft axle is movable between a first portion close to the opening and fully closed central liner compression channel and a second position distal the opening and fully closed central compression channel. The motor portion and handle portion are returned to their latched position once the liner is properly positioned but prior to actuation of the air gear motor 57. The compressed air is then provided to the pneumatic air gear motor 57 through pressure line 58 and regulator 59, the wringing device 10 is thus turned on when the pressurized air is supplied to the air gear motor. With the actuation of the wringing device 10 the air gear motor 57 rotates the first drive shaft/axle 51, which through the meshing of bevel gears causes the mutual rotation of the second, third, and fourth drive shafts/axles 61, 66, and 70. The rotation of the four drive shafts, in turn, results in the simultaneous rotation of the four rollers 46, 47, 48 and 49 in an upward direction tangentially along the central channel and against the liner therein. The rotation of the rollers causes the liner to be frictionally engaged by the rollers so that it is pulled upwardly through the central liner compression channel 40, thereby driving the wringing device 10 downwardly against the filled portion of the liner, as shown in FIG. 6 which illustrates a liner which is approximately half evacuated. The downward movement of the device causes the liner to be forced against the confining central liner compression channel 40 thereby squeezing the liner and forcing the liner content downwardly as the device moves along the length (height) of the liner, i.e., the central liner compression channel squeezes or wrings the liner as it passes therethrough. Because of the confined space of the central channel and the squeezing action of the rollers upon the liner as it passes between the rollers, the material within the liner approaching the wringing device 10 is forced downwardly along the un-wrung portion of the liner resulting in the near complete evacuation of material from the wrung portion, as shown in phantom lines in FIG. 6.

Should the wringing device 10 sense or fail to overcome a predetermined level of resistance or pulling of the liner, the air gear motor automatically deactivates or stalls to stop the rotation of the rollers. This stalling may occur when the evacuation of the liner contents ceases or slows to a certain level for any reason. This may be accomplished through the regulation of the air pressure level supplied to the air gear motor, as the air gear motor simply provides a select amount of torque upon the rollers commensurate with the air pressure supplied to it, i.e., when the resistance provide by the liner upon the rollers reaches a certain level which cannot overcome the roller torque the air gear motor simply stops or stalls until the liner tension on the rollers reaches a level below the roller torque level of the air gear motor and the roller rotation resumes. The liner tension reduces as material is discharged from the liner through the bottom fitment 23 and the liner thereby loosens or relaxes.

As the contents of the liner are expelled through the bottom fitment 23, either by gravity or by a vacuum, the wringing device 10 continually draws the excess liner through the central liner compression channel 40 through rotation of the four rollers. The gathering and compression of the liner through the central liner compression channel and the four direction gathering and compressing or squeezing action of the four rollers upon the liner passing through the central channel 40 ensures a near complete evacuation of the liner as any residual material clinging to the liner is forced downward as it approaches the four rollers. Once the wringing device has reached the end of the liner, the liner may pass completely through the central channel or the latch is opened and the roller drive shaft disengaged to allow the liner to pass completely through the central channel. Once the liner passes completely through the wringing device 10 very little material should remain within the liner as the material has been pushed downwardly and through the bottom fitment.

It should be understood that the just described wringing device 10 provides for a device which is easily portable and removable so that it may be moved between different devices easily and quickly.

It should be understood that the term central, as in central or compression channel, is not intended to denote an exact location in the center and is instead intended to denote a channel that is located within the confines of a periphery. Also, it should be understood that the central channel and/or central opening 43 are considered substantially "enclosed" as they do not include a gap which is large enough for a portion of the liner to become entrapped within the gap. As such, even though the support plate and housing are actually divided, the openings or channels therein are considered to be substantially enclosed.

It should be noted that the liner may be made of a material having a somewhat tacky exterior surface, such as from a film of metallocene resin, to maximize the gripping effect or pulling on the rollers upon the liner.

It should also be understood that the numeric terms used herein, such as first, second, third, etc., are intended for reference to the drawings and may not represent the exact same elements numerically contained or enumerated within the claims.

It thus is seen that a device for extracting material from inside a liner is now provided which overcomes problems associated with such devices of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. An intermediate bulk container liner wringing device for use with an intermediate bulk container flexible liner containing material therein, said wringing device comprising;

a mounting plate having an opening therein;

a first roller rotatably coupled to said mounting plate directly adjacent said opening of said mounting plate;

a second roller rotatably coupled to said mounting plate directly adjacent said opening of said mounting plate;

a third roller rotatably coupled to said mounting plate directly adjacent said opening of said mounting plate, a fourth roller mounted directly adjacent said opening of said mounting plate; a drive mechanism directly coupled to said first roller, coupled to said second roller, coupled to said third roller, and coupled to said fourth roller; and a guide block positioned between each adjacent pair of said rollers configured to guide the alignment of said rollers and to prevent the gathering of the intermediate bulk container flexible liner between adjacent said rollers during use, whereby the actuation of the drive mechanism causes the first, second and third roller to rotate thereby pulling the flexible liner between the rollers through the opening of the mounting plate.

2. The intermediate bulk container liner wringing device of claim 1 wherein said first roller, said second roller and said third roller are coupled together for simultaneous driven rotation by said drive mechanism.

3. The intermediate bulk container liner wringing device of claim 1 wherein said first roller is coupled to a first drive axle having a first bevel gear and a second bevel gear, wherein said second roller is coupled to a second drive axle having a third bevel gear configured to mesh with said first bevel gear of said first drive axle.

4. The intermediate bulk container liner wringing device of claim 3 wherein said third roller is coupled to a third drive axle having a fourth bevel gear configured to mesh with said second bevel gear of said first drive axle.

5. The intermediate bulk container liner wringing device of claim 1 wherein said fourth roller is movable between a first position adjacent said opening and a second position distal said opening.

6. The intermediate bulk container liner wringing device of claim 1 wherein said second drive axle includes a fifth bevel gear, and wherein said fourth roller is coupled to a fourth drive axle having a sixth bevel gear configured to mesh with said fifth bevel gear of said second drive axle.

7. The intermediate bulk container liner wringing device of claim 1 wherein said first roller and said third roller are generally axially parallel to each other, and wherein said second roller and said fourth roller are generally axially parallel to each other, and wherein said first and third rollers are generally axially perpendicular to said second and fourth roller.

8. An intermediate bulk container liner wringing device for use with an intermediate bulk container flexible liner containing material therein, said wringing device comprising;

a first pair of generally axially parallel aligned rollers;

a second pair of generally axially parallel aligned rollers, said second pair of generally axially parallel aligned rollers being generally axially perpendicular to said first pair of generally axially parallel aligned rollers;

wherein each said roller of said first pair of generally axially parallel aligned rollers is spaced away from each other to define a liner compression channel there between, and each said roller of said second pair of generally axially parallel aligned rollers is spaced away from each other to further define said liner compression channel there between, a drive mechanism coupled to both said first and second pair of generally axially parallel aligned rollers; and a guide positioned between each adjacent roller of said first and second pair of generally axially parallel aligned rollers configured to guide the alignment of said rollers and to prevent the gathering of the intermediate bulk container flexible liner between adjacent rollers during use, whereby the actuation of the drive mechanism causes the first and second pair of generally axially parallel aligned rollers to rotate thereby pulling the liner through the linear compression channel between the rollers.

9. The intermediate bulk container liner wringing device of claim 8 wherein said first and second pair of generally axially parallel aligned rollers are coupled together for simultaneous driven rotation by said drive mechanism.

10. The intermediate bulk container liner wringing device of claim 9 wherein each roller of said first and second pair of generally axially parallel aligned rollers is coupled to a separate and distinct drive axle having at least one bevel gear, and wherein each said bevel gear is configured to mesh with another bevel gear of another drive axle for simultaneous driven rotation of each said drive axle.

11. The intermediate bulk container liner wringing device of claim 8 wherein one said roller of either said first pair of generally axially parallel aligned rollers or said second pair of generally axially parallel aligned rollers is movable between a first position adjacent said linear compression channel and a second position distal said compression channel.

12. An intermediate bulk container liner wringing device for use with an intermediate bulk container flexible liner containing material therein, said wringing device comprising;

a wringing plate having a compression channel in the form of an aperture formed within said wringing plate, said aperture being sized and shaped to receive the flexible liner therethrough while the intermediate bulk container flexible liner is in a squeezed configuration, and a drive mechanism mounted adjacent said wringing plate for gripping and forcing the flexible liner through said compression channel aperture of said wringing plate wherein the size of the compression channel aperture causes direct contact between the intermediate bulk container flexible liner and the wringing plate about the aperture to cause the intermediate bulk container liner to be squeezed upon itself to extract the material from within the intermediate bulk container liner, whereby the forcing of the flexible liner through the wringing plate compression channel generally prevents contents within the flexible liner from passing through the wringing plate.

13. The intermediate bulk container liner wringing device of claim 12 wherein said drive mechanism includes a first roller having a first peripheral contact surface and coupled to a first axle, a second roller having a second peripheral contact surface and coupled to a second axle, a third roller having a third peripheral contact surface and coupled to a third axle, a fourth roller having a fourth peripheral contact surface and coupled to a fourth axle.

14. The intermediate bulk container liner wringing device of claim 13 wherein said fourth roller is movable between a first position adjacent said compression channel and a second position distal said compression channel.

* * * * *